US006827347B2

(12) United States Patent
Ito et al.

(10) Patent No.: US 6,827,347 B2
(45) Date of Patent: Dec. 7, 2004

(54) SHEET CONTAINER

(75) Inventors: Yukio Ito, Tokyo (JP); Yuichi Sakamoto, Tokyo (JP); Tadahiro Iwai, Tokyo (JP); Tetsuro Kikuchi, Tokyo (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 205 days.

(21) Appl. No.: 10/297,543

(22) PCT Filed: Apr. 4, 2002

(86) PCT No.: PCT/JP02/03386

§ 371 (c)(1),
(2), (4) Date: Dec. 4, 2002

(87) PCT Pub. No.: WO02/083537

PCT Pub. Date: Oct. 24, 2002

(65) Prior Publication Data

US 2003/0137096 A1 Jul. 24, 2003

(30) Foreign Application Priority Data

Apr. 6, 2001 (JP) ..... 2001-108658

(51) Int. Cl.[7] ..... B65H 43/06

(52) U.S. Cl. ..... 271/222; 271/220; 271/219; 271/217; 271/213; 271/258.01; 271/262

(58) Field of Search ..... 271/220, 222, 271/207, 213, 214, 215, 217, 219, 258.01, 262; 270/58.09

(56) References Cited

U.S. PATENT DOCUMENTS

| | | | | |
|---|---|---|---|---|
| 4,678,072 A | | 7/1987 | Kobayashi et al. | |
| 5,282,611 A | * | 2/1994 | Ueda et al. | 270/58.09 |
| 5,419,423 A | | 5/1995 | Ishida et al. | |
| 5,564,691 A | | 10/1996 | Hatamachi et al. | |
| 5,597,152 A | * | 1/1997 | Chinzei | 270/39.05 |
| 5,622,364 A | * | 4/1997 | Dutton et al. | 271/117 |
| 5,771,433 A | * | 6/1998 | Kimijima | 399/369 |
| 5,897,110 A | * | 4/1999 | Fujiwara | 271/4.01 |
| 6,076,817 A | * | 6/2000 | Kobayashi et al. | 270/58.09 |
| 6,378,860 B1 | * | 4/2002 | Gutierrez et al. | 271/217 |

FOREIGN PATENT DOCUMENTS

KR 8904965 12/1989

* cited by examiner

*Primary Examiner*—Patrick Mackey
(74) *Attorney, Agent, or Firm*—Welsh & Katz, Ltd.

(57) ABSTRACT

A paper sheet processing device that accommodates various types of paper sheet performs a smooth accommodating action by accurately performing a full-state detection action in respect of the accommodated paper sheets. Full-state detecting unit 2 of the paper sheet container (paper money container) stores current values exceeding a reference value as detection signals a, b, c and, of the stored detection signals a, b, c, determines that the stacker 42 constituting a paper sheet accommodating section is full based on the detection signal c stored in the substantially latter half period K' of the paper sheet accommodating action period T' by the paper money guiding unit 43.

3 Claims, 10 Drawing Sheets

SHEET CONTAINER

TECHNICAL FIELD

The present invention relates to paper sheet containers arranged in the interior of automatic vending machines, money changing machines and games machines and in particular relates to a paper sheet container having detection means for detecting when the device is full of paper sheets.

BACKGROUND ART

In the interior of machines of various types such as automatic vending machines, money changing machines and games machines, there is typically provided a paper money container that accommodates paper money that has been inserted from a paper money insertion port in a stacker constituting a paper money accommodation section after payment adjustment.

A conventional paper money container as shown in FIG. 7, which is a schematic cross-sectional view of the main part thereof, comprises paper money guiding unit 43 wherein paper money 31 fed into a paper money container 41 is pressed into a stacker 42 by means of a pressing plate 43*a* and a motor 44 that drives the paper money guiding device 43.

Of these, the paper money guiding unit 43 is arranged at the end of the paper money feed path and link 47 comprising a pantograph arm is pivoted on a pressing plate 43*a* thereof. Furthermore, an eccentric cam 46 is mounted on the rotary shaft of the motor 44 so that when the motor 44 is driven, the eccentric cam 46 is rotated, driving the link 47 and thereby moving the pressing plate 43*a* of the paper feed guiding unit 43 in parallel fashion towards the stacker 42.

The pressing plate 43*a* is constantly biased towards the eccentric cam 46 by biasing means, not shown, with the result that when the motor 44 is driven, the pressing plate 43*a* executes reciprocating motion as shown by an arrow W.

With such a conventional paper money container 41, when the paper money 31 inserted from the paper money insertion port, not shown, is fed along the paper money feed path and arrives at the end thereof, the paper money 31 is arranged on the right-hand side of the pressing plate 43*a* and both edges thereof are respectively fitted and inserted into paper money guides 48. When the motor 44 is then driven, as shown in FIG. 7, the pressing plate 43*a* of the paper money guiding unit 43 is moved in parallel fashion towards the stacker 42 causing approximately the middle in the width direction of the paper money 31 to be pressed so that the paper money 31 is guided towards the stacker 42. When both edges of the paper money 31 escape from the paper money guides 48, the paper money 31 is accommodated in the stacker 42.

After the paper money 31 has been accommodated in the stacker 42, the pressing plate 43*a* returns to the initial position by being driven in parallel fashion towards the eccentric cam 46 by the motor 44.

Details of the paper money accommodating action of the paper money guiding unit 43 are disclosed in Unexamined Japanese Patent Publication No. 60-77287. The reference symbol 49 is a spring that constantly biases the paper money 31 arranged in the stacker 42 towards the pressing plate with the aid of a plate 50.

The current value in the motor 44 that performs the paper money accommodating action changes with time due to the characteristics of the motor 44 itself and the load of the paper money accommodating action.

FIG. 8 is a time chart showing the operating condition of the motor 44 in the paper money accommodating action and the control unit, etc. (to be described later) in the paper money container 41, showing in particular the changes of a detection signal stored in the control unit, a CARRY signal that indicates the paper money accommodation action by the paper money guiding unit 43 and the current value that is applied to the motor 44.

The horizontal axis towards the right-hand side of the drawing in FIG. 8 indicates the time axis, in which a passage of time is indicated as it moves along the time axis to the right-hand side in the drawing. In the current waveform of the motor 44, the vertical axis represents the magnitude of the current value.

With this conventional paper money container 41 (FIG. 7), when the paper money 31 reaches the end of the paper money feed path, the motor 44 is started and the paper money accommodating action is commenced by the pressing plate 43*a* as described above. At this point, a considerable load due to factors such as the inertial force due to the rotor acts on the motor 44 immediately after start-up. As a result, this current value rises abruptly after start-up of the motor 44, as shown by a peak A of the current waveform of the motor 44 shown in FIG. 8.

Also, after the peak A, the current first drops as the motor 44 is shifting to steady operation. However, on the other hand, the current value of the motor 44 again rises as shown by the peak B of the current waveform of the motor 44 of FIG. 8, since the paper money 31 is pressed into the stacker 42 with the aid of the pressing plate 43*a* and load for causing the paper money 31 to escape from the paper guides 48 (FIG. 7) is applied to the motor 44.

When the paper money 31 escapes from the paper money guides 48 (FIG. 7) and is accommodated in the stacker 42, the pressing plate 43*a* returns to the initial position and at this point load for enabling the paper money 31 to escape from the paper money guides 48 is no longer applied to the motor 44. The current value of the motor 44 therefore drops as shown by the current waveform of the motor 44 after the peak B of FIG. 8.

It should be noted that the peak B of FIG. 8 indicates the current value of the motor 44 immediately prior to the escape of the paper money 31 from the paper money guides 48 (FIG. 7).

If now the stacker 42 (FIG. 7) accommodating the paper money 31 is not full, the pressing force by which the spring 49 presses the pressing plate 43*a* through the paper money 31 stacked and accommodated in the stacker 42 is small, so the load of the spring 49 applied to the motor 44 through the pressing plate 43*a* is small. Consequently, the current applied to the motor 44 drops as shown by the current waveform after the peak B of FIG. 8.

On the other hand, if the stacker 42 (FIG. 7) of FIG. 1 is full, the pressing force by which the spring 49 presses the pressing plate 43*a* through the paper money 31 stacked and accommodated in the stacker 42 is large, with the result that a large load is again applied through the pressing plate 43*a* to the motor 44. Accordingly, when the current waveform of the motor 44 after the peak B of FIG. 8 is observed, it is found that the current value of the motor 44 rises abruptly as shown by the peak C of FIG. 9 in which portions that are identical with FIG. 8 are indicated by the same reference symbols.

The pressing plate 43*a* returns to the initial position after being pressed by the accommodated paper money, during which the load for making the paper money 31 escape from the paper money guides 48 is no longer applied to the motor 44. Thus, the current value of the motor 44 after the peak C of FIG. 9 drops as shown by the current waveform.

It should be noted that the peak C of FIG. 9 indicates the current value of the motor 44 immediately before the pressing plate 43*a* presses and accommodates the paper money 31 in the full stacker 42.

Whether the stacker 42 is full or not is arranged to be detected in the conventional paper money container 41 by utilizing this fluctuation of the current value of the motor 44 in the paper money accommodating action.

This full-state detecting unit that detects the full-state of the stacker 42 comprises current detection unit that detects the current value of the motor 44, control unit that determines in accordance with the detected current value of the motor 44 whether the stacker is full or not and paper money accommodating action detection unit that detects the commencement of the paper money accommodating action of the paper money guiding unit 43.

In this regard, the threshold level that is stored beforehand by the control unit shown in FIG. 8 and FIG. 9 is a fixed current value that is larger than the maximum current value indicated by the peak B detected in the course of the action of accommodating the paper money 31 and is smaller than the maximum current value indicated by the peak C that is displayed when the full condition of the stacker 42 is detected.

The control unit compares the detected current value of the motor 44 with the previously stored reference value. If the result of the comparison is that the detected current value of the motor 44 exceeds the reference value, the current value of the motor 44 as an electrical signal as indicated by the detection signals (comparator outputs) a and c of FIG. 8 and FIG. 9 is stored.

The detection signal a is the detection signal corresponding to the peak A generated initially on start-up of the motor 44 and the detection signal c is the detection signal corresponding to the peak C of the motor 44 when the stacker is in full condition.

Also, when the commencement of the paper money accommodating action is detected by the paper money accommodating action detection unit, the control unit turns the CARRY signal of FIG. 8 and FIG. 9 ON.

With the conventional full-state detecting unit constituted in this way, the control unit determines whether or not a detection signal has been stored therein in a prescribed time Ta after a lapse of the prescribed time S from the time point where the CARRY signal was turned ON. Then, as shown by the detection signal c of FIG. 9, if it determines that detection signal was stored in the prescribed time Ta, the control unit decides that the stacker 42 has become full and closes the paper money insertion port in question by driving a shutter of the paper money insertion port, not shown, so as to prevent subsequent acceptance of paper money 31.

On the other hand, if it is determined that a detection signal has not been stored in the prescribed time Ta, as shown in FIG. 8, it is decided that the stacker 42 is not full and, with the aid of the shutter, the control unit maintains the open condition of the paper money insertion port, to accept further paper money 31.

In the above full-state detection decision processing, the detection and decision of full-state are performed in the period excluding the period until the lapse of a prescribed time S from the start-up time point of the motor 44. The reason of this is to avoid erroneous decision on the full-state of the stacker 42 due to the fact that, as shown by the peak A of the motor 44 shown in FIG. 8 and FIG. 9, the current value of the motor 44 normally exceeds the reference value immediately after start-up, which is stored as the detection signal a, and if it is decided that the stacker 42 was full based on this detection signal a, it would be erroneously decided that the stacker 42 was full.

The paper money container sometimes deals with paper money of various types, such as so-called stiff paper money which is difficult to bend and highly flexible paper money which is likely to be bent.

Although conventional paper money containers 41 (FIG. 7) do handle such various types of paper money, if paper money that is stiffer than ordinary paper money 31 is to be accommodated in the stacker 42, a large load is temporarily applied to the motor 44 in order to cause the paper money to escape from the paper money guides 48.

FIG. 10 is a time chart showing in the same way as in the case of FIG. 8 and FIG. 9 the operating condition of the motor 44 and the control unit, etc. in the case where a stiff paper money is accommodated, parts which are the same as in the case of FIG. 8 and FIG. 9 being indicated by the same reference symbols.

As shown by the peak B' of the current waveform of the motor 44 in FIG. 10, when a stiff paper money is accommodated, a larger load is applied to the motor 44 for releasing the stiff paper money from the paper money guides 48 (FIG. 7) than in the case of an ordinary paper money 31, so the current value of the motor 44 during the process of the paper money accommodating action becomes even larger than the current value (peak B of FIG. 8 and FIG. 9) when the ordinary paper money 31 is accommodated. Also, the period T' for the paper money accommodating action by the pressing plate 43*a* also becomes longer (T'>T) than the time T for the paper money accommodating action for the ordinary paper money 31 (FIG. 8 and FIG. 9).

FIG. 10 also shows the condition when the stacker 42 is not full even after accommodation of the paper money, as shown by the current waveform of the motor 44, which drops after the peak B'.

With the paper money container 41, there was the problem that, if the current value of the motor 44 becomes greater than or equal to the reference value (threshold level) during the paper money accommodating action in the prescribed time Ta as shown by the peak B' of the current waveform of the motor 44 of FIG. 10, since a detection signal b' is stored in the control unit within the prescribed time Ta, even though a condition (not full) exists in which the paper money can still be accommodated in the stacker 42, the full-state detecting unit erroneously decides that the stacker 42 has become full and stops acceptance of paper money 31.

This problem of erroneous actuation of the full-state detection by handling paper money of various different types is also presented in the same way not merely for paper money containers but also for paper sheet containers (for example, coupon accommodating devices or gift token accommodating devices) that detect a condition of full-state of other types of sheets of paper (for example, coupons or gift tokens). In particular, there was a possibility of erroneous detection of full-state occurring during the accommodation action of accommodating new notes (paper money) or stiff sheets of paper (for example gift tokens, beer tokens or goods tokens).

In view of the above circumstances, an object of the present invention is to provide a paper sheet processing device that accommodates paper sheets of various different types, in which a smooth accommodating action can be performed, thanks to performance of an accurate full-state detection in respect of the accommodated paper sheets.

DISCLOSURE OF THE INVENTION

According to the present invention, in a paper sheet container comprising: paper sheet guiding unit that presses paper sheets that are fed thereto into a paper sheet accommodating section and that guides the paper sheets into the paper sheet accommodating section; a motor that drives the paper sheet guiding unit; and full-state detecting unit that detects the current value of the motor and determines whether or not the paper sheet accommodating section is full in accordance with whether or not this current value exceeds a reference value that is set beforehand, the full-state detecting unit stores a current value that exceeds the reference value as a detection signal and, of such stored detection signals, determines that the paper sheet accommodating section is full on the basis of a detection signal stored in a period of substantially the latter half of the period of the paper sheet accommodating action by the paper sheet guiding unit.

The full-state detecting unit of the paper sheet feed device according to the present invention stores a current value exceeding a reference value as a detection signal and determines that the paper sheet accommodating section is full based on, of such stored detection signals, a detection signal stored in a period of substantially the latter half of the paper sheet accommodating action period by the paper sheet guiding unit. Therefore, occurrence of interruption of acceptance of paper sheets due to an erroneous decision that the paper sheet accommodating section is full based on a detection signal stored during the process of accommodating the paper sheets, irrespective of the condition in which the paper sheets can be accommodated in the paper sheet accommodating section, can be avoided as far as possible. Thus, an accurate decision concerning detection of full-state can be made corresponding to the period for the paper money accommodating action of various types of paper money.

Consequently, according to the present invention, in a paper sheet processing device wherein various types of paper sheets are accommodated, a paper sheet feed device can be provided wherein the accommodating action can be performed in smooth fashion by performing accurate full-state detecting action for accommodated paper sheets.

BEST MODE FOR CARRYING OUT THE INVENTION

A paper money container that handles paper money as an example of paper sheets is described in detail below as an embodiment of a paper sheet container according to the present invention.

Figure 7:
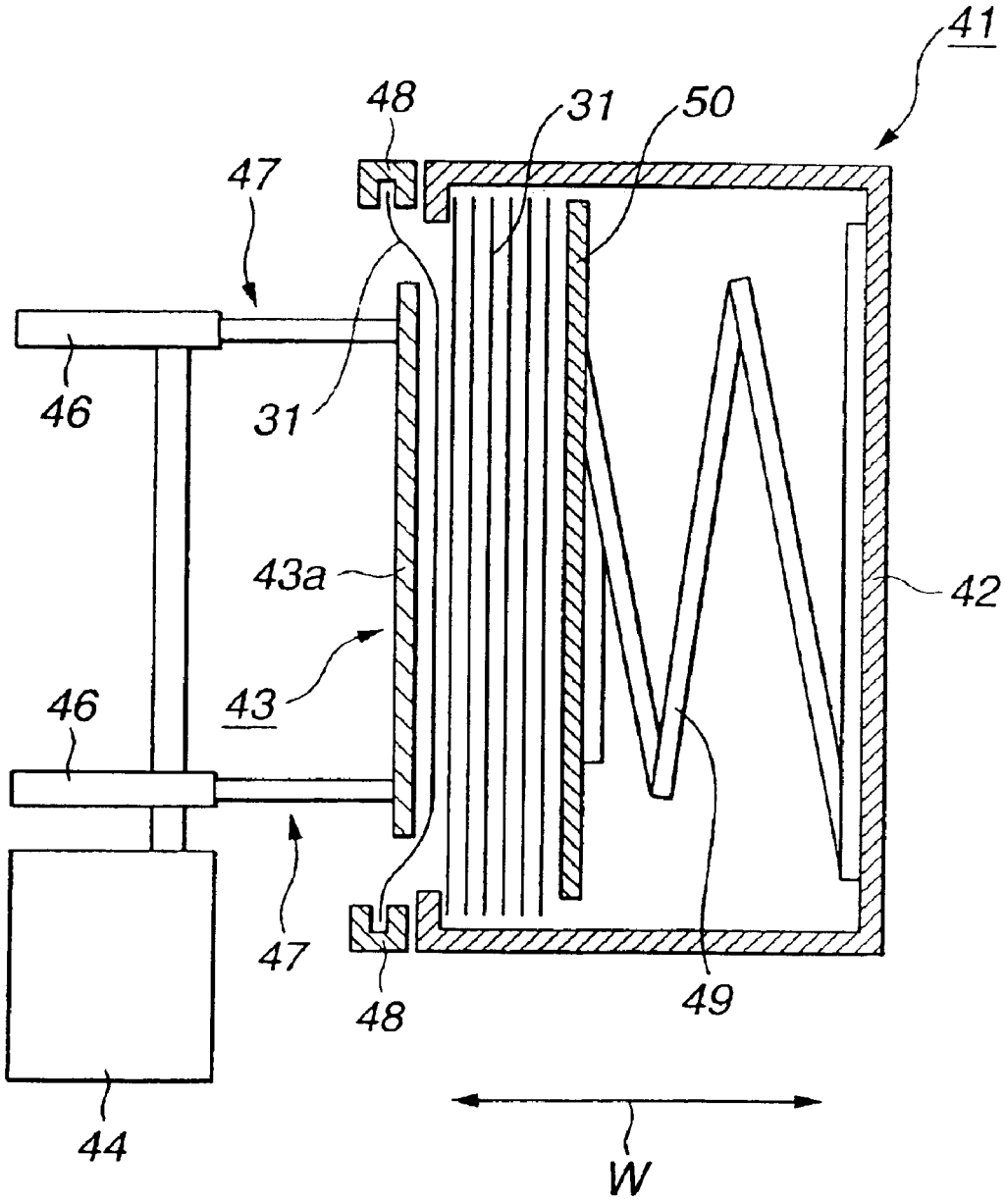
FIG. 7 is a schematic cross-sectional view of principal part of a paper money container constituting a practical example of a conventional paper sheet container.

The paper money container according to the present invention, like the conventional paper money container shown in FIG. 7, comprises paper sheet guiding unit 43 comprising a pressing plate 43*a* that guides a paper money 31 into a stacker 42 by pressing the paper money 31 that has been fed to the paper money container 41 in the direction of the stacker 42, and a motor 44 that drives the paper money guiding unit 43.

In this paper money container also, in the same way as in the conventional paper money container, the paper money 31 inserted from a paper money insertion port, not shown, is fed along the paper money feed path until it reaches the end thereof, whereupon the motor 44 is driven, causing the pressing plate 43*a* to press on substantially the middle in the width direction of the paper money 31 and causing the paper money 31 to escape from the paper money guides 48 and to be guided towards the stacker 42 so that the paper money 31 is accommodated in the stacker 42.

After the paper money 31 has been accommodated in the stacker 42, the pressing plate 43*a* is returned to its initial position by parallel movement towards the eccentric cam 46 of FIG. 7, by driving of the motor 44.

The paper money 31 accommodated in the stacker 42 is kept to be pressed towards the pressing plate 43*a* by means of a spring 49 with the aid of a plate 50.

Furthermore, in the paper money container, full-state detecting unit is provided that detects the current signal of the motor 44 and decides that the stacker 42 is full when the current value of the detected current signal is at or above the pre-set reference value.

Figure 1:
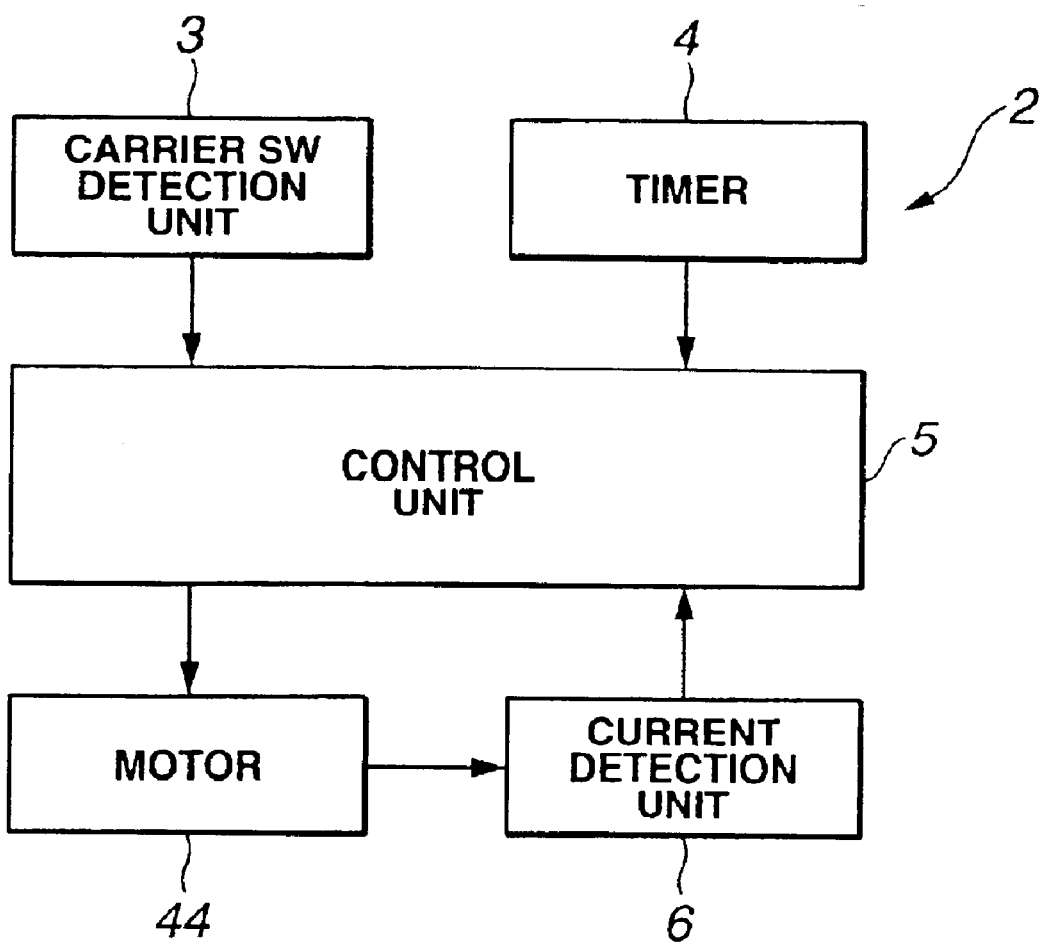
FIG. 1 is a block diagram illustrating the construction of a full-state detecting unit 2 constituting a paper money container in an embodiment of a paper sheet feed device according to the present invention.

FIG. 1 is a block diagram showing the configuration of the full-state detecting unit 2.

This full-state detecting unit 2 comprises a carrier SW detection unit (paper money accommodating action detection unit) 3, a timer (time measurement unit) 4, control unit 5 and current detection unit 6.

Of these, the carrier SW detection unit 3 detects the commencement of rotation and the stoppage of rotation of the motor 44.

The current detection unit 6 detects the drive current value of the motor 44 that is driven through the control unit 5 and sends information relating to the detected current value of the motor 44 to the control unit 5.

The control unit 5 comprises peripheral circuitry whose chief constituent elements are a CPU (central processing unit), main memory unit and auxiliary memory unit.

This control unit 5 turns the CARRY signal ON on detection of commencement of rotation of the motor 44 by the carrier SW detection unit 3, and turns the CARRY signal OFF on detection of stoppage of rotation of the motor 44. Also, the control unit 5 determines that the paper money accommodating action has started when the CARRY signal turns ON and determines that the paper money accommodating action has terminated when the CARRY signal turns OFF.

Also, the control unit 5 measures the period from the commencement of the paper money accommodating action until it terminates, that is, the paper money accommodating action period, by using the timer 4.

In addition, the control unit 5 stores a previously fixed reference value (threshold level) and compares this reference value with the current value of the motor 44 detected by the current detection unit 6. Also, if the current value of the motor 44 exceeds the reference value, this current value is stored as the detection signal (comparator output). In this embodiment, the reference value that is stored beforehand in the control unit 5 is the same reference value as the reference value (threshold level of FIG. 8 to FIG. 10) employed in the full-state detection processing by the conventional paper money processing device.

Also, the control unit 5 calculates the period of substantially the latter half of this paper money accommodating action period, using the measured paper money accommodating action period.

This "substantially latter half" period is the period for identifying the detection signal that is used to determine that the stacker 42 is full, of the detection signals stored in the paper money accommodating action period. The control unit 5 determines that the stacker 42 is full based on the detection signal stored in this substantially latter half period.

The reason why the decision by the control unit 5 that the stacker 42 is full is made on the basis of the detection signal stored in this substantially latter half period is as follows. Namely, the present applicants have discovered by experiment the fact that, although in accommodating various types of paper money such as stiff paper money or ordinary paper money and so on, the paper money accommodating action period for various types of paper money was not ordinarily fixed, even when the paper money of any characteristics of was accommodated, the detection signal representing genuine full-state of the stacker 42 was detected in a fixed period in the substantially latter half of the respective paper money accommodating action periods, irrespective of the length of these paper money accommodating periods.

It was also ascertained by experiment by the present applicants that this substantially latter half period is a period of the latter 60% of the respective paper money accommodating action periods.

This is because of the following facts. Namely, the detection signal indicating full-state of the stacker 42 is detected at the position of the top dead center of the eccentric cam 46, full-state ought theoretically to be detected in the latter half 50% of the paper money accommodating action period. However, the experiment has ascertained that it is appropriate to make the decision concerning whether the stacker 42 is full with this initial theoretical value of 50% increased by 10% that is on the basis of the detection signal stored in the approximately 60% period representing the latter half of the paper money accommodating action period, since time differences may be produced in the detection of the detection signal by fluctuation of the drive voltage supplied to the motor 44 depending on the temperature environment in the paper money container, or since errors may be generated in the paper money accommodating action period due to causes such as the amount of paper money accommodated in the stacker 42 being more or less.

Figure 9:
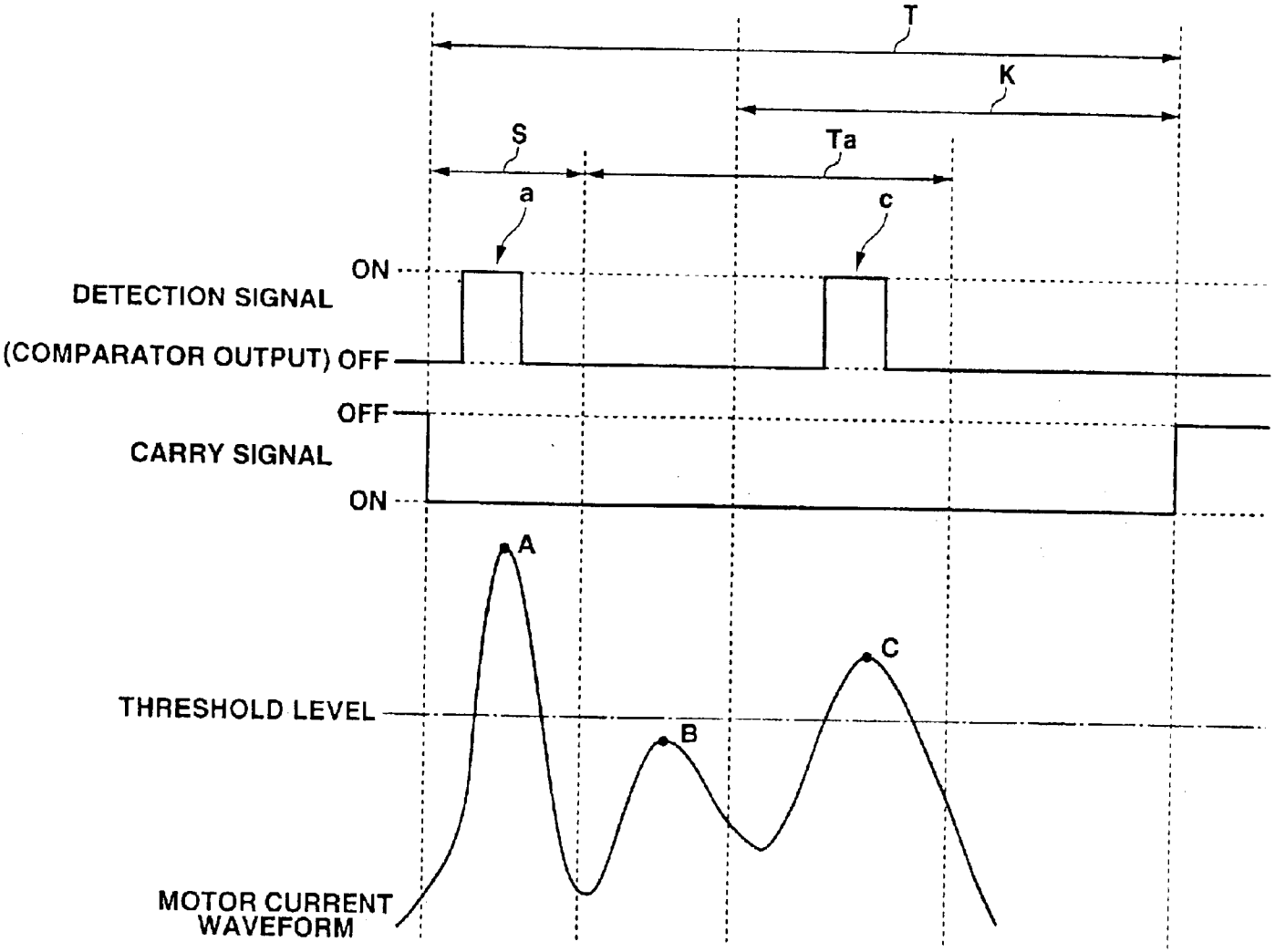
FIG. 9 is a time chart illustrating, in the same way as FIG. 8, the operating condition of a motor and control unit when ordinary paper money is accommodated in the conventional paper money container.

For example, FIG. 9 shows the appearance when the stacker 42 has become full after accommodating ordinary paper money 31 as described above, in which detection signal c indicating full-state of the stacker 42 is stored at a fixed time K in substantially the latter half of the paper money accommodating action period T (period of 60% of the paper money accommodating action period T).

Figure 2:
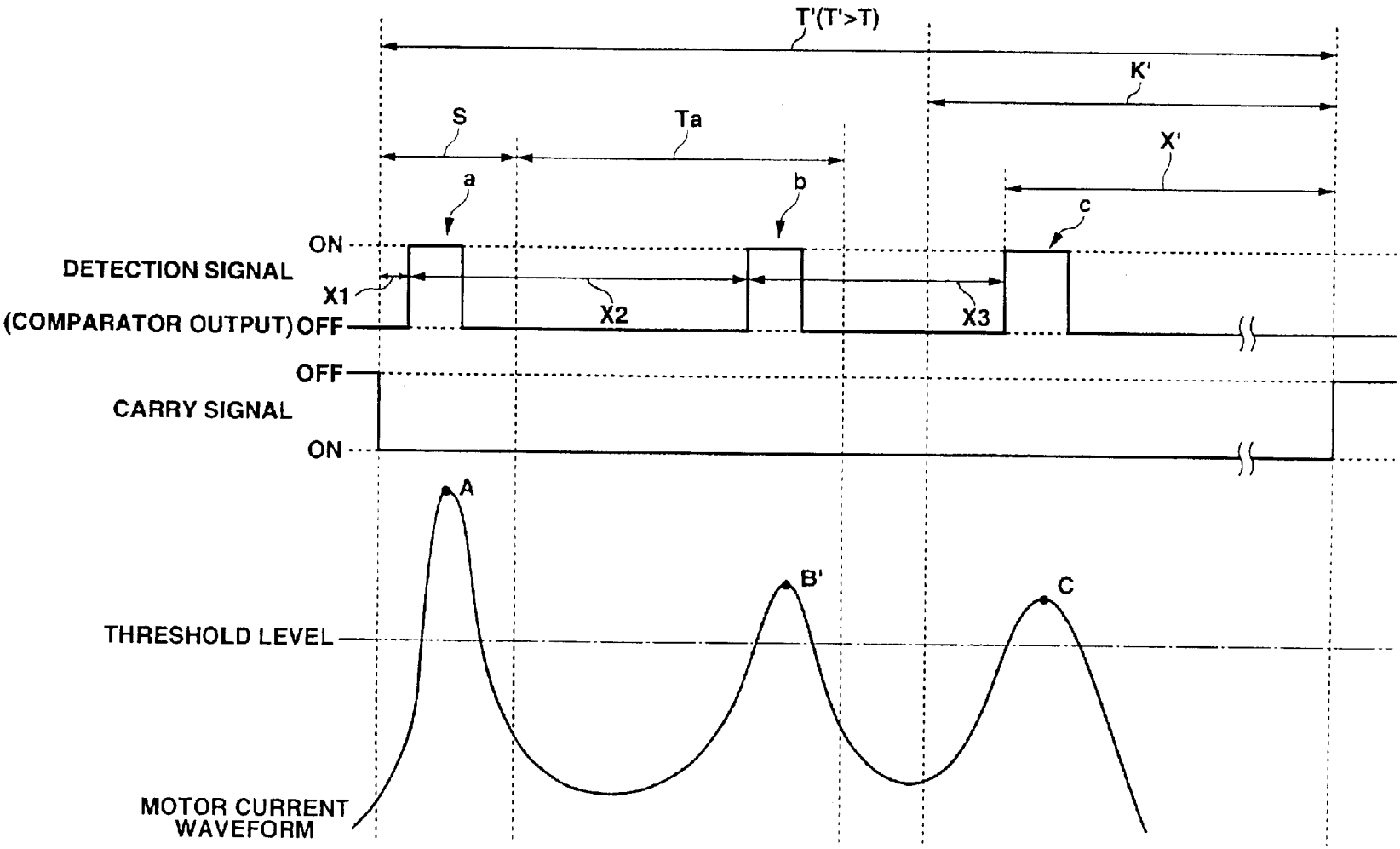
FIG. 2 is a time chart illustrating, in the paper money container of FIG. 1, the operating condition of a motor and control unit when stiff paper money is accommodated and in particular is a view illustrating the relationship of a current waveform indicating the current value of the current signal of the motor, a CARRY signal indicating the drive condition of the motor and a comparator output indicating a full-state detection signal.
Figure 8:
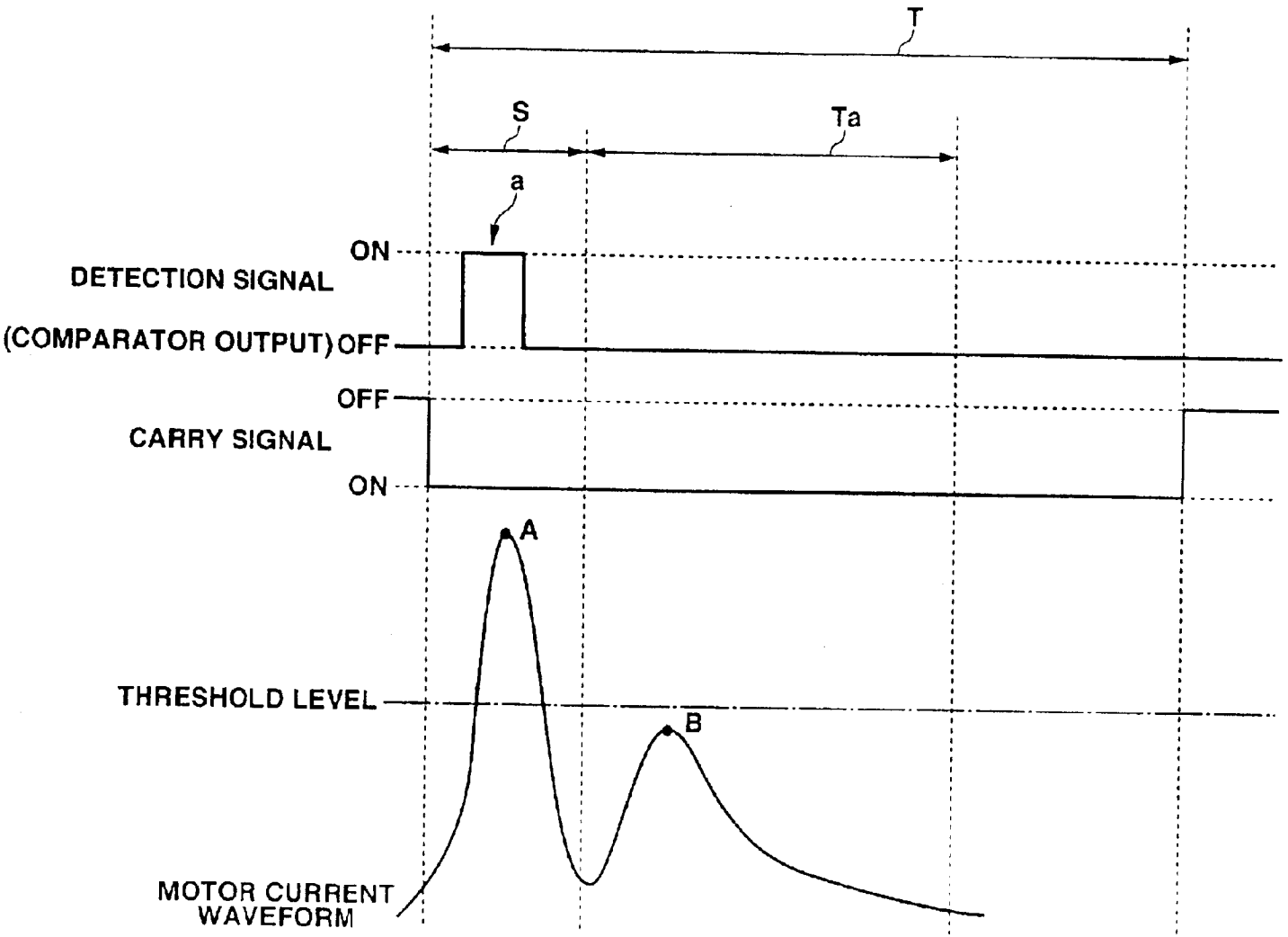
FIG. 8 is a time chart illustrating the operating condition of a motor and control unit when ordinary paper money is accommodated in the conventional paper money container, and in particular is a view illustrating the relationship of a current waveform indicating the current value of the current signal of the motor, a CARRY signal indicating the drive condition of the motor and a comparator output indicating a full-state detection signal.
Figure 10:
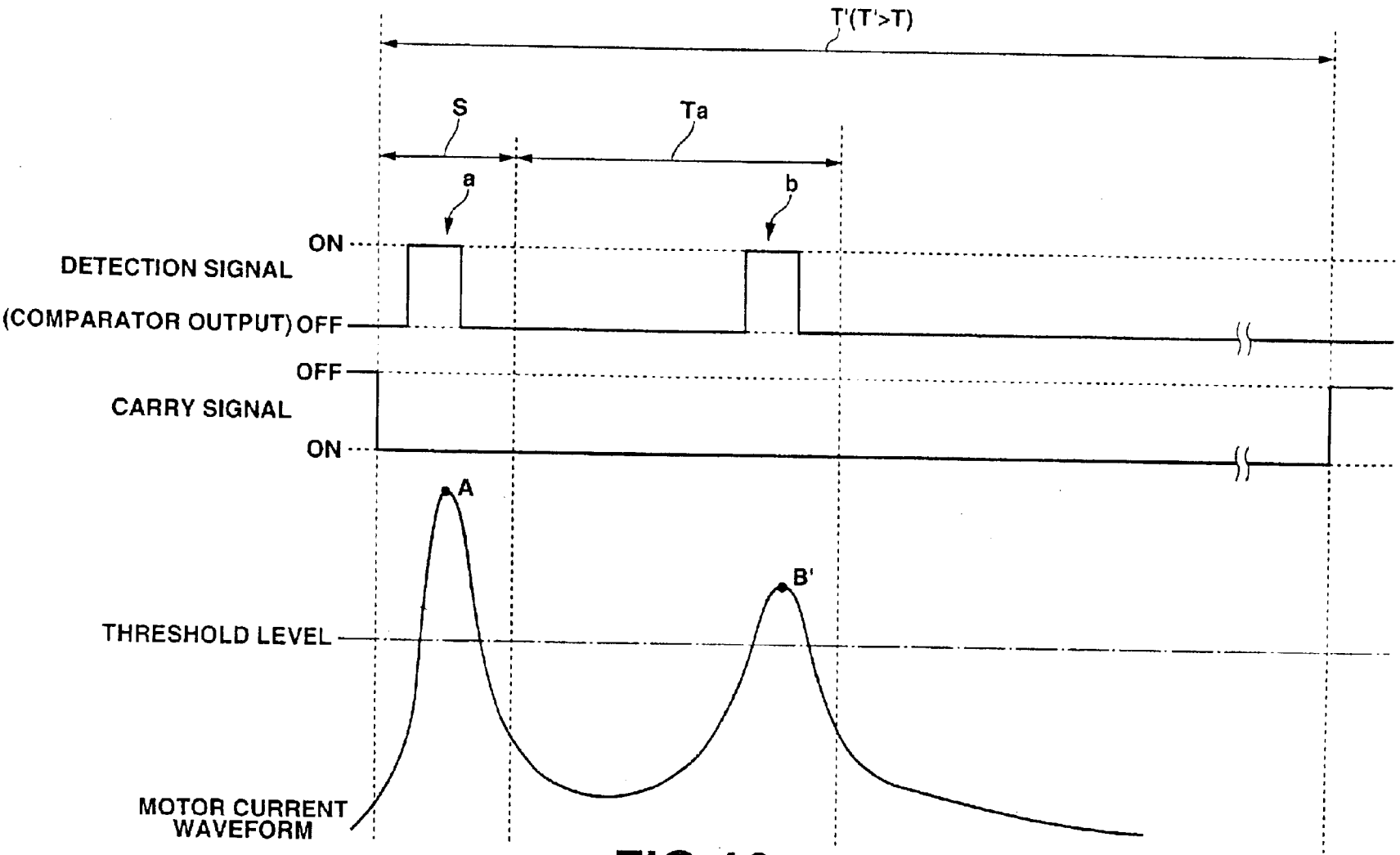
FIG. 10 is a time chart illustrating, in the same way as FIG. 8 and FIG. 9, the operating condition of a motor and control unit when stiff paper money is accommodated in the conventional paper money container.

Next, FIG. 2 is a time chart illustrating in the same way as in the case of FIG. 8 to FIG. 10 the operating condition of the motor 44 and control unit 5 and so on when paper money that is stiffer than ordinary paper money 31 is accommodated, in which parts that are identical with those of FIG. 8 to FIG. 10 are indicated by the same reference symbols. FIG. 2 shows that the stacker 42 has fully accommodated the paper money 31, as indicated by the detection signal c.

As shown in FIG. 2, although the period T' of the paper money accommodating action is longer for accommodating stiff paper money than the paper money accommodating action period T for accommodating ordinary paper money 31 (T'>T), the detection signal c representing full-state of the stacker 42 is stored at a fixed time K' in the substantially latter half of the paper money accommodating period T'.

The detection signal b of FIG. 2 is a signal that is generated due to that face that the load of the motor 44 that is applied in order to cause the stiff paper money to escape from the paper money guides 48 (FIG. 7) is larger than that in the case where ordinary paper money 31 is accommodated.

Figure 3:
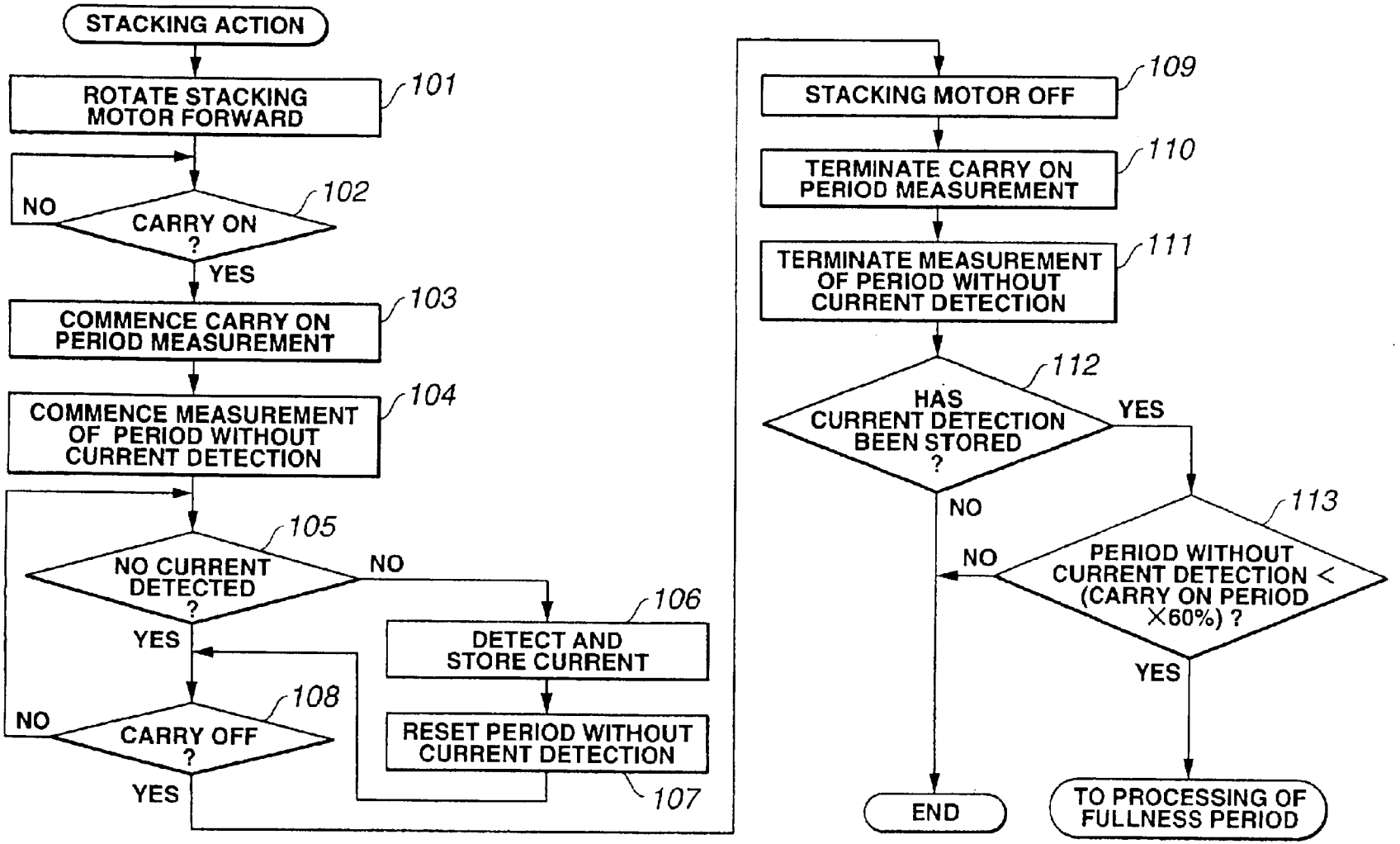
FIG. 3 is a flow chart illustrating the processing sequence of control unit that controls the paper money container of FIG. 1.

Next, the paper money accommodating action (stacking action) of this paper money container will be described with reference to the flow chart of FIG. 3, illustrating the processing sequence of the control unit 5.

First, the case will be described with reference to the time chart of FIG. 4, in which ordinary paper money 31 is being accommodated in the stacker 42 that is not yet full.

Figure 4:
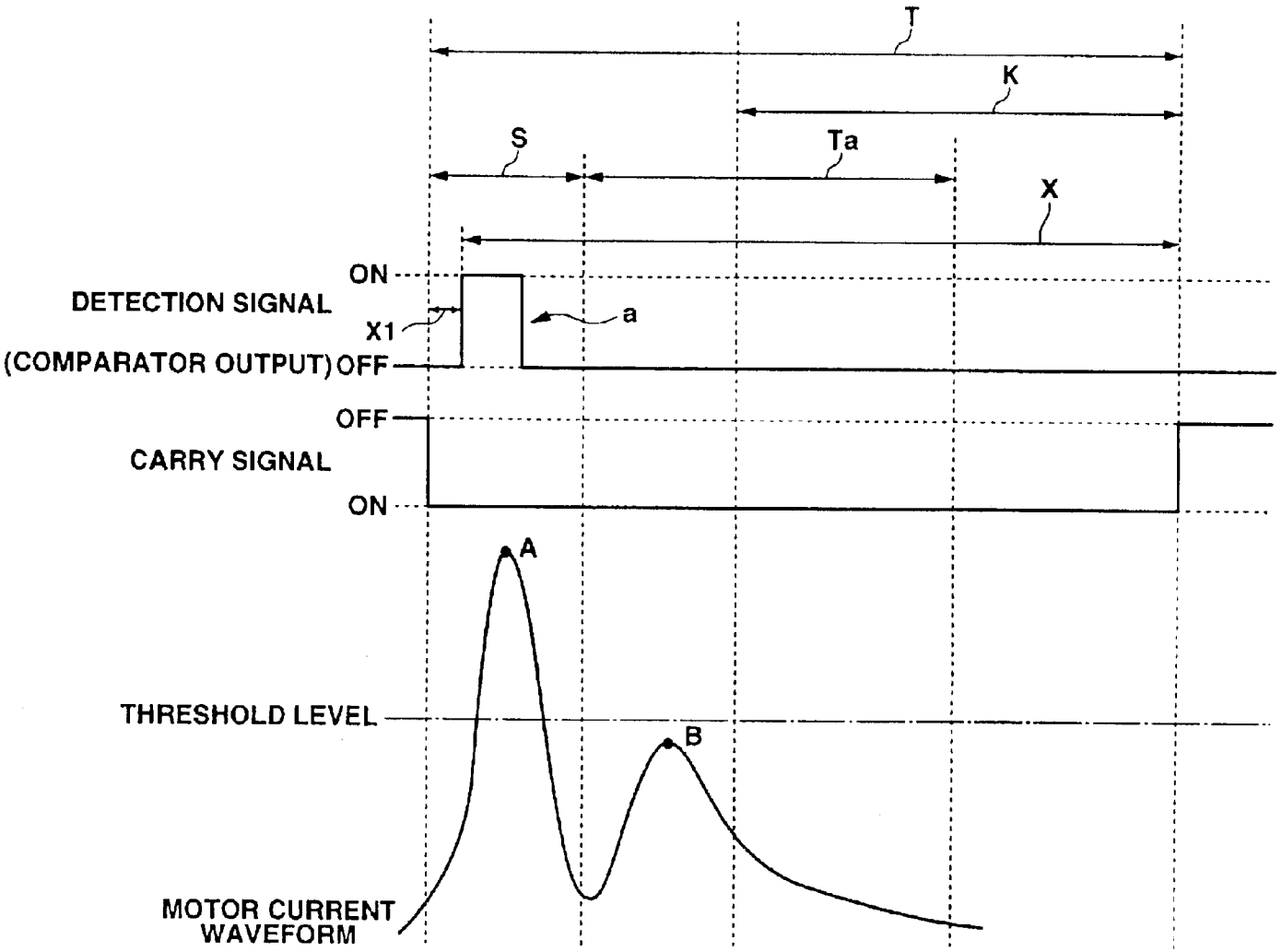
FIG. 4 is a time chart that illustrates in the same way as in the case of FIG. 2, in the paper money container of FIG. 1, the operating condition of a motor and control unit when ordinary paper money is accommodated.

FIG. 4 is a time chart illustrating, in the same way as in the case of FIG. 8, the operating conditions of the motor 44 and the control unit 5 and so on when accommodating ordinary paper money 31. Parts which are the same as parts in FIG. 8 are given the same reference symbols.

In FIG. 4, the rise in the current value of the motor 44 indicated by the peak A immediately after start-up of the motor 44 depends on the properties of the motor 44 itself.

Also, the rise of the current value of the motor 44 indicated by the peak B of this current waveform is shown during the course of the operation of accommodating ordinary paper money. Also, FIG. 4 illustrates the appearance in which the stacker 42 that has accommodated ordinary paper money 31 is not yet full, as can be seen from the appearance of the drop of the current value of the motor 44 depicted after the peak B of the current waveform of the motor 44.

In the paper money container, when the ordinary paper money 31 reaches a prescribed position at the end of the paper money feed path, the control unit 5 starts up the motor 44 (step 101) and determines by means of the carrier SW detection unit 3 whether or not the CARRY signal has been turned ON, that is, whether or not the paper money accommodating action has been commenced (step 102).

In the step 102, if it is detected that the CARRY signal has not been turned ON, the processing of step 102 is repeated. On the other hand, if the CARRY signal is found to have been turned ON, the control unit 5 determines that the paper money accommodating action has been commenced and drives a timer 4 to commence measurement of the period for which the carry signal continues to be ON (CARRY ON period). In other word, the paper money accommodating action period T of the motor 44 shown in FIG. 4 (step 103). Concurrently with the commencement of measurement of the paper money accommodating action period T, the control unit 5 commences (step 104) measurement of the period X (hereinbelow referred to as the "period of no current detection") for which the current value detected from the current detection unit 6 does not exceed the fixed reference value (threshold level) that has been previously stored by using the timer 4, and determines as to whether or not the detected current value exceeds the fixed reference value, that is, whether current detection has taken place or not (step 105).

If it is found that the current value detected in the step 105 does not exceed the fixed reference value (there is no current detection) (YES in step 105), measurement of the period of no current detection X is continued to be performed and a determination is made as to whether or not the CARRY signal has been turned OFF or not, by using the carrier SW detection unit 3. If this has not been turned OFF, the processing of step 105 is repeated until the CARRY signal is found to have been turned OFF (step 108).

On the other hand, if, in step 105, it is found that the current value detected from the current detection unit 6 has exceeded the fixed reference value (current has been detected) (NO in step 105), the detection signal is stored (step 106) based on the current value at which this reference value was exceeded, for example as shown by the detection signal a of FIG. 4. At the same time, measurement of the period X of no current detection is reset (step 107). Measurement of the period X of no current detection is then recommenced.

In the processing from step 105 to step 107, for example in the case where ordinary paper money 31 is accommodated as shown in FIG. 4, firstly, measurement of the no-current period X is commenced from the time point of commencement of measurement of the paper money accommodating action period T. Sometimes, however, the current value immediately after start-up of the motor 44 rises as shown by the peak A of the current waveform and exceeds the fixed reference value. In such cases, the control unit 5 stores the detection signal a based on the detection of the current value of the motor 44 when the fixed reference value was exceeded and resets the measured no-current period X1, then recommences measurement of the period of no current detection X, from the time point of this reset.

In the processing from the step 105 to step 107, the processing of step 105 is repeated until the control unit 5 ascertains that the CARRY signal has been turned OFF, in the step 108.

If, in step 108, it is found that the CARRY signal has been turned OFF, the control unit 5 stops the supply of power to the motor 44, the drive of the timer 4 is stopped(step 109), terminating the measurement of the paper money accommodating action period T (step 110). Simultaneously, the measurement of the period of no current detection X which was performed with the aid of the timer 4 is terminated(step 111).

In the processing of the step 111, if no other detection signal is stored before the paper accommodating action terminates after storage of the detection signal a after commencement of measurement of the paper money accommodating action period T as shown in FIG. 4, the period of no current detection X that is finally measured is the period from the time point of the resetting of the timer 4 simultaneously with the storage of the detection signal a up to the termination of the paper money accommodating action.

Next, the control unit 5 determines whether or not a detection signal has been stored (whether current detection storage has taken place or not) (step 112). If it finds that the detection signal has stored, the control unit 5 calculates the period K of substantially the latter half from the paper money accommodating action period T that was finally measured, that is, in this case, a period of 60% of the paper money accommodating action period T and determines whether or not the finally measured period of no current detection X is shorter than the substantially latter half period K of the paper money accommodating action period T(step 113). In the step 113, if it is ascertained that this period of no current detection X is longer than the period of substantially the latter half of the paper money accommodating action period T (60% of the paper money accommodating action period T) K, it is concluded that the stacker 42 is not full that is that the number of accommodated sheets of paper money is less than the prescribed number (NO in step 113).

This is because, since it has been found by experiment by the present applicants that, if the stacker 42 is not full, a detection signal is not stored in the period K in substantially the latter half of the paper money accommodating action period T(60% of the paper money accommodating action period T), and therefore, in the processing from step 101 to step 112, if the period X of no current detection that is finally measured is longer than the period K of substantially the latter half of the paper money accommodating action period T, it can be concluded that the stacker 42 is not full.

Consequently, if the period X of no current detection that is finally measured when step 111 has terminated is the period from the time point where the timer 4 was reset by storage of the detection signal a as shown in FIG. 4 up to termination of the paper money accommodating action, a determination is made to ascertain whether or not this period of no current detection X is shorter than the substantially latter half period K of the paper money accommodating action period T. If it is found that this period of no current detection X is longer than the period K of substantially the latter half of the paper money action period T, as shown in FIG. 4, the control unit 5 decides that the stacker 42 is not full.

On the other hand, if, in step 113, it is ascertained that the period of no current detection X of FIG. 4 is shorter than the period K of substantially the latter half of the paper money accommodating action period T, the control unit 5 concludes that the stacker 42 is full (YES in step 113).

Next, the case where it is ascertained that the stacker 42 accommodating ordinary paper money 31 is fill will be described.

Figure 5:
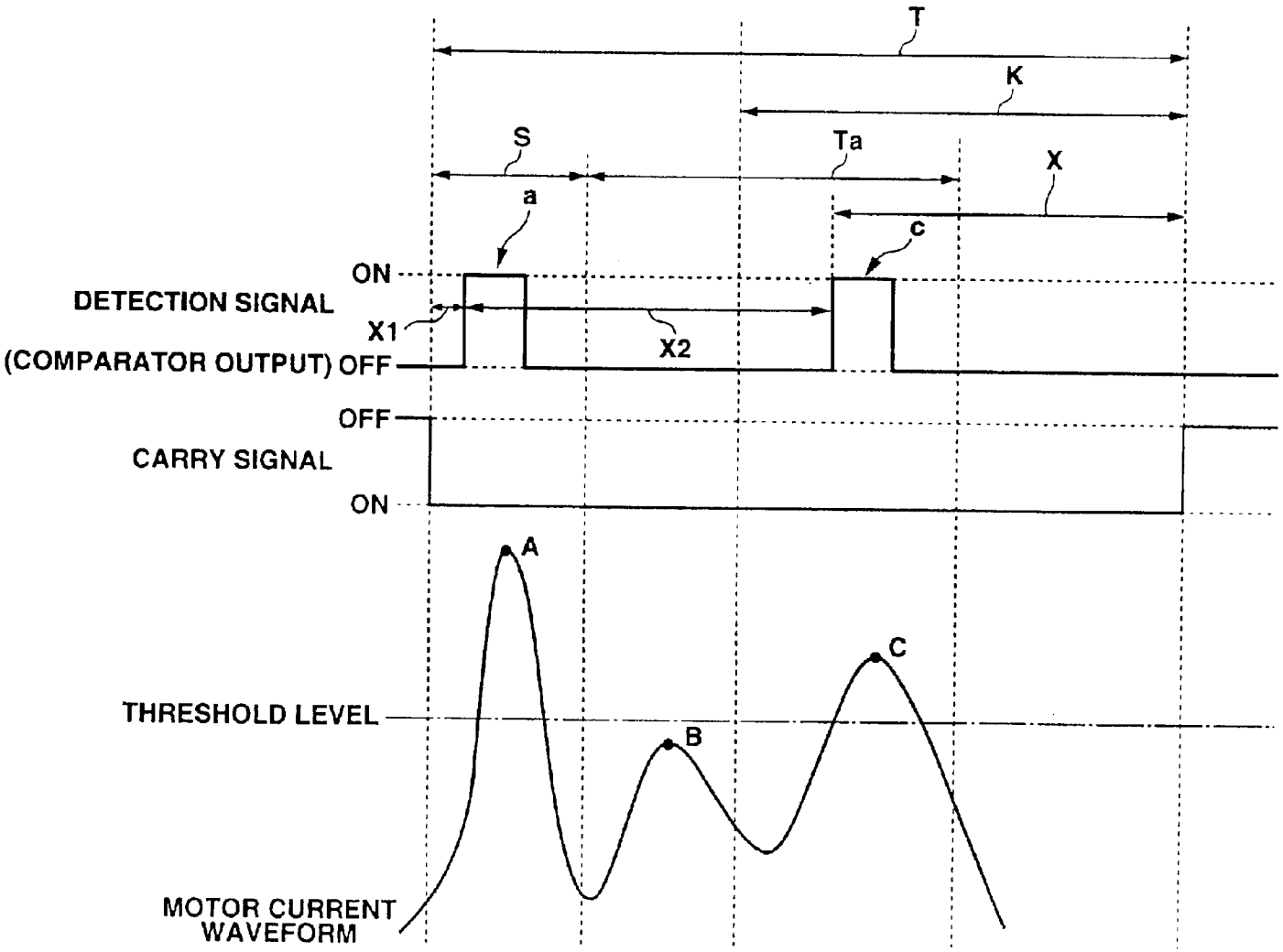
FIG. 5 is a time chart illustrating, in the same way as in the case of FIG. 2 and FIG. 4, the operating condition of a motor and control unit when ordinary paper money is accommodated in the paper money container of FIG. 1.

FIG. 5 is a time chart illustrating the operating condition of the motor 44 and the control unit 5 and so on when accommodating ordinary paper money 31 in the same way as in the case of FIG. 2, FIG. 4 and FIG. 8 to FIG. 10, and in particular, illustrates the case where the stacker 42 accommodating the paper money 31 is full. In FIG. 5, parts which are the same as in the case of FIG. 2, FIG. 4 and FIG. 8 to FIG. 10 are indicated by the same reference symbols.

As shown in FIG. 5, in the case where ordinary paper money 31 is accommodated and the stacker 42 is full, when the control unit 5 performs the processing from step 101 to the step 113, in the paper money accommodating action period T, the current value of the motor 44 again exceeds the fixed reference value as shown by the peak C of the current waveform, after the current value of the motor 44 has exceeded a fixed reference value as shown by the peak A of this current waveform. It should be noted that the rise of the current value of the motor 44 indicated by the peak C of the current waveform shows that the stacker 42 is full.

With this paper money container, the processing of the step 103 to the step 113 is performed as described above. As shown in FIG. 5, if the current value of the motor 44 exceeds a fixed reference value, the measurement of the no-current period X is performed a plurality of times by the processing of the step 103 to the step 111.

Describing this more specifically, by the processing of the step 103 to the step 111, first of all, the measurement of the no-current period X is commenced from the measurement commencement time point of the paper money accommodating action period T. However, since the measured no-current period X1 is reset concurrently with the storage of the detection signal a, the measurement of the no-current period X is recommenced from the time point of this resetting.

However, after this commencement, since the current value of the motor 44 again exceeds the fixed reference value as shown by the peak C of the current waveform of the motor 44, the detection signal c obtained as a result of this detection is stored by the control unit 5 and measurement of the no-current period X is freshly commenced by again resetting the measured no-current period X2.

Consequently, the finally measured period X of no current detection at the termination of the step 111 is the time from the time point where the timer 4 was reset by storage of the detection signal c up to the end of the paper money accommodating action period T. Therefore, in the step 113, a determination is made as to whether or not the finally measured period of no current detection X is shorter than the substantially latter half period K of the paper money accommodating action period T and if this period of no current detection X is shorter than the substantially latter half period K of the paper money accommodating action period T as shown in FIG. 5, it is concluded that the stacker 42 is full.

Next, referring to FIG. 2, the case where paper money that is stiffer than normal is being accommodated and the stacker 42 is full will be described.

In this case, when the control unit 5 performs the processing of the step 101 to the step 113 described above, the paper money accommodating action period T' is longer than the paper money accommodating action period T for accommodating ordinary paper money 31, in order to accommodate stiff paper money (T'>T).

Also, within the paper money accommodating action period T', the current value of the motor 44 again exceeds the fixed reference value as shown by the peak B' of the current waveform after the current value of the motor 44 has exceeded the fixed reference value as shown by the peak A of the current waveform, and thereafter the current value of the motor 44 also exceeds the fixed reference value as shown by the peak C of the current waveform.

It should be noted that the rise of the current value of the motor 44 indicated by the peak B' of the current waveform of the motor 44 of FIG. 2 is because the paper money that is being accommodated is stiff. Also, the rise of the current value of the motor 44 indicated by the peak C of this current waveform indicates that the stacker 42 is full.

With the paper money container, processing is performed from the step 103 to the step 113 as described above. However, if the current value of the motor 44 exceeds the fixed reference value as shown in FIG. 2, the measurement of the no-current period X' is performed a plurality of times by the processing of the step 103 to the step 111.

Specifically, by the processing of the step 103 to the step 111, first of all, the measurement of the no-current period X' is commenced from the time point of commencement of the measurement of the paper money accommodating action period T. Since the no-current period X1 measured concurrently with the storage of the detection signal a is reset, the measurement of the period of no current detection X' is recommenced from the time point of this reset.

After this commencement, the current value of the motor 44 again exceeds the fixed reference value as shown by the peak B' of the current waveform of the current value of the motor 44, so the control unit 5, in response to this detection, stores the detection signal b and again resets the measured no-current period X2 and freshly commences measurement of the no-current period X'.

After this, the current value of the motor 44 also exceeds the fixed reference value as shown by the peak C of the current waveform of the current value of the motor 44. On detecting this, the control unit 5 stores the detection signal c, resets the measured no-current period X3 and freshly commences measurement of the no-current period X'.

The period X' of no current detection that is finally measured at the termination of the step 111 is therefore the period from the time point of the resetting of the timer 4 in response to the storage of the detection signal c until the termination of the paper money accommodating action period T. In the step 113, it is ascertained whether or not the period of no current detection X' is shorter than the substantially latter half period K' calculated from the paper money accommodating action period T'. If the period of no current detection X' is in fact shorter than the substantially latter half period K' of the paper money accommodating action period T' as shown in FIG. 2, the stacker 42 is concluded to be full.

This is because, according to the experiments of the present applicants, it has been found that, even if the paper money accommodating action period T' is longer than the ordinary paper money accommodating action period T (T'>T), if the stacker 42 is full, a detection signal c is stored in substantially the latter half period K' of the paper money accommodating action period T' so, in the processing of the step 101 to the step 112, if the finally measured period of no current detection X' is shorter than the substantially latter half period K' of the paper money accommodating action period T', it can be concluded that the stacker 42 is full.

Next, the case where the stacker 42 that is accommodating stiff paper money is not full will be described.

Figure 6:
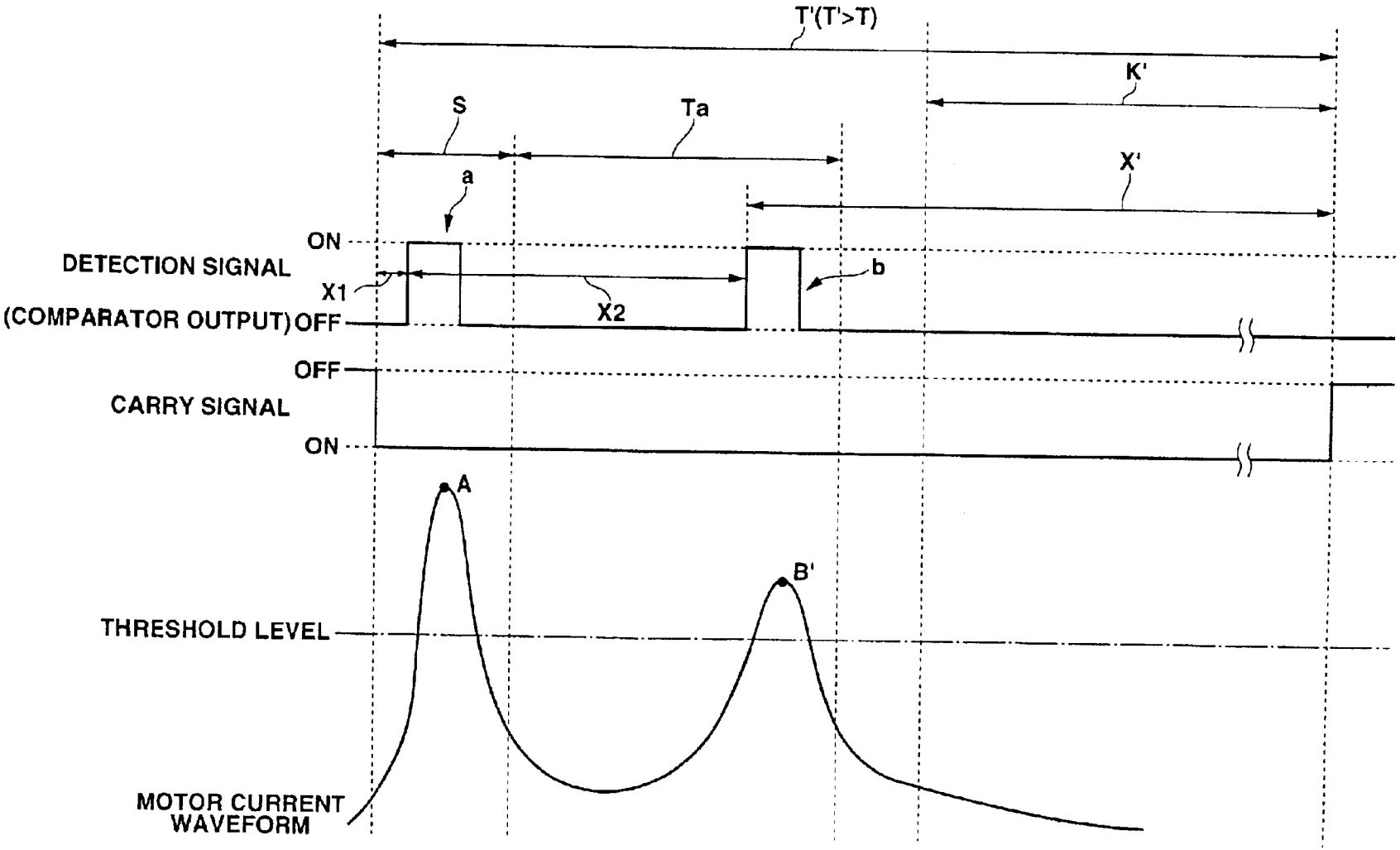
FIG. 6 is a time chart illustrating, in the same way as in the case of FIG. 2, FIG. 4 and FIG. 5, the operating condition of a motor and control unit, to be described later, when stiff paper money is accommodated in the paper money container of FIG. 1.

FIG. 6 is a time chart illustrating the operating condition of the motor 44 and the control unit 5 and so on when stiff paper money is being accommodated in the same way as in the case of FIG. 2, FIG. 4, FIG. 5 and FIG. 8 to FIG. 10, and in particular illustrating the case where the stacker 42 that has accommodated stiff paper money is not full. Parts in FIG. 6 which are the same as parts in FIG. 2, FIG. 4, FIG. 5 and FIG. 8 to FIG. 10 are given the same reference symbols.

In case that the stacker 42 that is accommodating stiff paper money 31 is not full, when the control unit 5 performs the processing of the step 101 to the step 113 described above, its paper money accommodating action period T' is longer than the paper money accommodating action period T for accommodating ordinary paper money 31 as described above (T'>T). Within the paper money accommodating action period T', after the current value of the motor 44 exceeds the fixed reference value as shown by the peak A of this current waveform, the fixed reference value of the current of the motor 44 is again exceeded as shown by the peak B' of the current waveform.

It should be noted that the rise of the current value of the motor 44 indicated by the peak B' of the motor 44 in FIG. 6 is due to the stiffness of the paper money that is being accommodated and does not indicate that the stacker 42 is full. FIG. 6 also shows that the stacker 42 that is accommodating this paper money is not full as shown by the drop of the current value of the motor 44 after the peak B'.

With the paper money container, the processing from the step 103 to the step 113 is performed as described above. As shown in FIG. 6, if the current value of the motor 44 exceeds the fixed reference value, measurement of the no-current period X' is repeated a plurality of times by the processing of the step 103 to the step 111.

To describe this in more detail, the measurement of the no-current period X' is first of all commenced from the time point of commencement of measurement of the paper money accommodating action period T by the processing of the step 103 to the step 111. However, since the measured no-current period X1 is reset concurrently with the storage of the detection signal a, the measurement of the no-current period X' is recommenced from the time point of this resetting.

After this commencement, the current value of the motor 44 again exceeds the fixed reference value for the current of the motor 44, as shown by the peak B' of its current waveform. Upon detection of this, the control unit 5 stores the detection signal B and commences fresh measurement of the no-current period X' by again resetting the measured no-current period X2.

Consequently, the finally measured period of no current detection X' at the termination of the step 111 is the period from the time point where the timer 4 was reset by storage of the detection signal b until the termination of the paper money accommodation action period T. In step 113 it is therefore determined whether or not this period of no current detection X' is shorter than the substantially latter half period K' calculated from the paper money accommodating action period T'.

Thus, if, in the step 113, the period of no current detection X' is longer than the substantially latter half period K' of the paper money accommodating action period T as shown in FIG. 2, it is concluded that the stacker 42 is not full.

This is because it has been ascertained by experiment by the present applicants that even if the paper money accommodating action period T' is longer than the ordinary paper money accommodating action period T (T'>T), no detection signal is stored in the substantially latter half period K' of the paper money accommodating action period T' so long as the stacker 42 is not full.

Thus, with the full-state detecting unit 2 of the paper money processing device 1 according to the present invention, even if, of the stored detection signals, there is a detection signal b stored outside the substantially latter half period K' of the paper money accommodating action period T' by the paper money guiding unit 43, the conclusion that the stacker 42 is full is not drawn on the basis of such a detection signal b.

Therefore, it is never concluded that that the stacker 42 is full on the basis of a detection signal b stored during the process of accommodating stiff paper money even though the stacker 42 is not in fact full, as did in the conventional device.

It should be noted that if the control unit determines that a detection signal has been stored in step 112, the control unit concludes that the stacker 42 is not full (NO in step 112). Since in this case it is, in the first place, not detected that the current value of the motor 44 has exceeded the fixed reference value, the stacker 42 is not concluded to be full.

It should be noted that, if the control unit 5 determines that the stacker 42 is full, it drives shutter arranged at the paper money insertion port to block the paper money insertion port so that insertion of the paper money 31 is thereafter blocked. However, if it determines that the stacker 42 is not full, the control unit 5 does not drive the shutter so acceptance of paper money inserted from the paper money insertion port is permitted.

In this way, the full-state detecting unit 2 of the paper money processing device 1 according to the present invention concludes that the stacker 42 is full on the basis of a detection signal c, of the stored detection signals, that was stored in the substantially latter half period K, K' of the respective paper money accommodating action periods T, T' by the paper money guiding unit 43 but does not conclude that the stacker 42 is full on the basis of a signal stored in a period other than the substantially latter half periods K, K', such as for example a detection signal b of FIG. 6 stored during the progress of accommodating stiff paper money or a detection signal a stored immediately after start-up of the motor 44. In this way it can therefore as far as possible be prevented that acceptance of paper money 31 is interrupted because of an erroneous conclusion that the stacker 42 is full based on a signal stored in a period other than the respective substantially latter half periods K, K', even though the stacker 42 is not in fact full, as happened conventionally. The action of accommodating various types of paper money 31 can thereby be conducted in a smooth fashion.

Also, since the full-state detecting unit 2 of the paper money container is arranged to arrive at the conclusion that the stacker 42 is full based on the detection signal stored in the substantially latter half periods K, K' of the respective paper money accommodating action periods T, T' by the paper money guiding unit 43, it can make a correct full-state detection decision in accordance with the various paper money accommodating action periods which vary depending on the various types of paper money 31 that are accommodated and in this way can perform an action of accommodating the various types of paper money 31 in smooth fashion.

Also, since the paper money container is arranged to arrive at the conclusion that the stacker 42 is full based on the detection signal stored in the substantially latter half periods K, K' of the respective paper accommodating action periods T, T' as described above, even in the case of changes of the environment such as the temperature of the location of installation of the automatic vending machine and so on where the paper money container is provided or changes in the environment such as fluctuation of the power source voltage of the motor 44 or in the case where the paper money accommodating action periods T, T' fluctuate in accordance with differences of the number of sheets of paper money to be accommodated in the stacker 42, the full-state detection action can be performed accurately in accordance with these paper money accommodating action periods T, T'.

Although in this embodiment a paper money container was described which accommodates various types of paper money 31, it should be noted that the present invention could of course be applied also to paper sheet containers (such as for example coupon accommodating devices or gift token accommodating devices) that accommodate various types of paper sheets (for example coupons or gift tokens). In particular, it is capable of solving problems such as erroneous detection of full-state during accommodating actions in which new notes (paper money) or stiff sheets of paper (such as for example gift tokens, beer tokens or goods tokens) are accommodated.

INDUSTRIAL APPLICABILITY

As described above, the paper sheet container according to the present invention is arranged in the interior of an automatic vending machine, money changing machine, or games machine and is useful as a paper sheet container comprising paper sheet full-state detection unit.

What is claimed is:

1. A paper sheet container comprising:

paper sheet guiding means for guiding paper sheets into a paper sheet accommodating section by pressing the paper sheets that are fed thereto into the paper sheet accommodating section; and a motor that drives the paper sheet guiding means; and full-state detecting means for detecting a current value of the motor to determine whether or not the paper sheet accommodating section is full in accordance with whether or not the current value exceeds a reference value that is set beforehand, characterized in that the full-state detecting means stores current values that exceeds the reference value as detection signals and, of the stored detection signals, determines that the paper sheet accommodating section is full based on a detection signal stored in a period of substantially a latter half of a period of the paper sheet accommodating action by the paper sheet guiding means.

2. The paper sheet container according to claim 1 characterized in that the substantially latter half period is a period of latter 60% of the paper sheet accommodating action period.

3. The paper sheet container according to claim 1 characterized in that the full-state detecting means comprises:

current detection means for detecting current values of the motor;

control means for storing a current value of the motor that exceeds the reference value as a detection signal;

paper sheet accommodating action detection means for detecting commencement and termination of the paper sheet accommodating action by the paper sheet guiding means; and time measurement means for measuring the paper sheet accommodating action period from the commencement and termination of the paper sheet accommodating action, and the control means calculates the substantially latter half period based on the measured paper sheet accommodating action period and determines that the paper sheet accommodating section is full based on the detection signal stored in the substantially latter half period.

* * * * *